US008149197B2

(12) United States Patent
Iijima et al.

(10) Patent No.: US 8,149,197 B2
(45) Date of Patent: Apr. 3, 2012

(54) ELECTRO-OPTICAL DEVICE, DRIVE METHOD FOR ELECTRO-OPTICAL DEVICE, AND ELECTRONIC APPARATUS

(75) Inventors: Chiyoaki Iijima, Nagano-ken (JP); Minoru Ikeda, Nagano-ken (JP)

(73) Assignee: Epson Imaging Devices Corporation, Tokyo (JP)

( * ) Notice: Subject to any disclaimer, the term of this patent is extended or adjusted under 35 U.S.C. 154(b) by 1524 days.

(21) Appl. No.: 11/537,729

(22) Filed: Oct. 2, 2006

(65) Prior Publication Data

US 2007/0075953 A1 Apr. 5, 2007

(30) Foreign Application Priority Data

Sep. 30, 2005 (JP) ..... 2005-287607

(51) Int. Cl.
*G09G 3/36* (2006.01)

(52) U.S. Cl. ..... 345/89; 345/99; 345/77

(58) Field of Classification Search ..... 345/99, 345/94, 66, 77, 690, 89
See application file for complete search history.

(56) References Cited

U.S. PATENT DOCUMENTS 7,499,014 B2 * 3/2009 Park ..... 345/99
2007/0030294 A1 * 2/2007 Sawyers et al. ..... 345/690
2008/0211749 A1 * 9/2008 Weitbruch et al. ..... 345/77

FOREIGN PATENT DOCUMENTS

| | | | |
|---|---|---|---|
| EP | 1591922 | | 11/2005 |
| JP | 04-102892 | A | 4/1992 |
| JP | 08-241060 | A | 9/1996 |
| JP | 11-184436 | A | 7/1999 |
| JP | 11184436 | A * | 7/1999 |
| JP | 2003-173170 | | 6/2003 |
| JP | 2003-233359 | | 8/2003 |
| JP | 2003-233360 | | 8/2003 |
| JP | 2003-280605 | A | 10/2003 |

* cited by examiner

*Primary Examiner* — Amare Mengistu
*Assistant Examiner* — Joseph G Rodriguez
(74) *Attorney, Agent, or Firm* — Lowe, Hauptman, Ham & Berner, LLP

(57) ABSTRACT

An electro-optical display device includes an electro-optical panel, a scanning line drive circuit for scanning the scanning lines of the panel during a selection period, and a signal line drive circuit for outputting a data signal to a predetermined pixel through the corresponding data line of the panel in synchronization with the scanning of the scanning line drive circuit. During the selection period during which the data signal is output to the predetermined pixel, the duration of the ON voltage interval corresponding to a grayscale level having the longest OFF voltage interval is longer than the duration of the OFF voltage interval corresponding to a grayscale level having the longest ON voltage interval.

20 Claims, 6 Drawing Sheets

ELECTRO-OPTICAL DEVICE, DRIVE METHOD FOR ELECTRO-OPTICAL DEVICE, AND ELECTRONIC APPARATUS

RELATED APPLICATION

The present application is based on, and claims priority from, Japanese Application No. 2005-287607(P), filed Sep. 30, 2005, the disclosure of which is incorporated by reference herein in its entirety.

BACKGROUND

1. Technical Field

The present invention relates to electro-optical devices, drive methods therefor, and electronic apparatuses.

2. Related Art

Liquid crystal devices, which are one kind of electro-optical devices, can be divided into various types according to the electrode configuration, the drive method, etc. For example, drive methods for liquid crystal devices can be largely divided into an active matrix drive type using switching elements, such as transistors and diodes, and a passive matrix drive type without using such switching elements. Between the two drive methods, the passive matrix drive type contributes to reducing power consumption since switching elements are not used, and thus, passive-matrix-drive-type liquid crystal devices can be manufactured relatively easily at low cost (for example, see JP-A-2003-233359, JP-A-2003-233360, and JP-A-2003-173170).

In a liquid crystal device using the above-described passive matrix drive type, as schematically shown in FIG. 7, when a black color image S is displayed in a white frame image, crosstalk occurs between the black color image S and the white frame image, resulting in the difference in the luminance between white portion A located vertically parallel with the black color image S and white portion B adjacent to white portion A.

It is now assumed, as shown in |FIG. 8A|, that the waveform of data lines (hereinafter also referred to as "segment lines") for displaying the black color image is SegA, while the waveform of segment lines B for displaying the white portion adjacent to the black color image S is SegB. In this case, when pulse-width-modulation grayscale display is performed, the 0-grayscale waveform is applied to SegA, while the N-grayscale waveform is applied to SegB.

In practice, however, noise, such as that shown in |FIG. 8B|, occurs in the actual common waveform Com because of a change in the voltage applied to the segment lines. In this case, as indicated by the elliptic portions Y shown in FIG. 8B, the difference in the luminance caused by the above-described crosstalk is generated due to the difference in the level of noise between segment A for displaying the black color image and segment B for displaying the white frame image.

SUMMARY

An advantage of the invention is that it provides an electro-optical device that can reduce the influence caused by crosstalk to improve the display quality, a drive method for the electro-optical device, and an electronic apparatus including the electro-optical device.

According to an aspect of the invention, there is provided an electro-optical device that performs grayscale display, including an electro-optical panel having a plurality of scanning lines, a plurality of data lines intersecting with the corresponding plurality of scanning lines, and a plurality of pixels disposed at intersections of the corresponding plurality of scanning lines and the corresponding plurality of data lines, a scanning line drive circuit that sequentially scanning the plurality of scanning lines by supplying a scanning signal to the corresponding scanning line during a selection period and by supplying a non-selection signal to the corresponding scanning line during a non-selection period, and a signal line drive circuit that outputs a data signal subjected to a pulse width modulation with a predetermined number of grayscale levels to a predetermined pixel through the corresponding data line in synchronization with the scanning of the scanning line drive circuit. During the selection period during which the data signal is output to the predetermined pixel, a period for which a grayscale level having the longest OFF voltage interval is turned ON is set to be longer than a period for which a grayscale level having the longest ON voltage interval is turned OFF.

With this configuration, scanning line noise (hereinafter also referred to as "common noise") occurring in the grayscale level having the longest OFF voltage interval can be equivalent to common noise occurring in the grayscale level having the longest ON voltage interval, thereby making it possible to reduce the level of crosstalk.

It is preferable that, when the period during which the grayscale level having the longest OFF voltage interval is turned ON is indicated by $T_0$, and when the period during which the grayscale level having the longest ON voltage interval is turned OFF is indicated by $T_N$, $T_0/T_N$ may range from 3 to 20. In this case, the level of crosstalk can be decreased without impairing the contrast.

It is preferable that, during a predetermined selection period, an interval for which the data signal is turned ON may be set before an interval for which the data signal is turned OFF, and during a selection period after the predetermined selection period, an interval for which the data signal is turned ON may be set after an interval for which the data signal is turned OFF. Accordingly, if the above-described so-called "right-adjust left-adjust pulse width modulation driving" is employed, crosstalk can be effectively reduced.

It is preferable that a line inversion drive method in which voltage polarities of the scanning signal and the data signal are simultaneously inverted a plurality of times in one frame may be used. In this case, crosstalk can be effectively reduced.

According to another aspect of the invention, there is provided a drive method for an electro-optical device that performs grayscale display, the electro-optical device including an electro-optical panel including a plurality of scanning lines, a plurality of data lines intersecting with the corresponding plurality of scanning lines, and a plurality of pixels disposed at intersections of the corresponding plurality of scanning lines and the corresponding plurality of data lines. The drive method includes sequentially scanning the plurality of scanning lines by supplying a scanning signal to the corresponding scanning line during a selection period and by supplying a non-selection signal to the corresponding scanning line during a non-selection period, and outputting a data signal subjected to a pulse width modulation with a predetermined number of grayscale levels to a predetermined pixel through the corresponding data line in synchronization with the scanning of the scanning line drive circuit. During the selection period during which the data signal is output to the predetermined pixel, a period for which a grayscale level having the longest OFF voltage interval is turned ON is set to be longer than a period for which a grayscale level having the longest ON voltage interval is turned OFF.

According to this drive method, common noise occurring in the grayscale level having the longest OFF voltage interval can be equivalent to common noise occurring in the grayscale level having the longest ON voltage interval, thereby making it possible to reduce the level of crosstalk.

It is preferable that, when the period during which the grayscale level having the longest OFF voltage interval is turned ON is indicated by $T_0$, and when the period during which the grayscale level having the longest ON voltage interval is turned OFF is indicated by $T_N$, $T_0/T_N$ may range from 3 to 20. In this case, the level of crosstalk can be decreased without impairing the contrast.

It is preferable that, during a predetermined selection period, an interval for which the data signal is turned ON may be set before an interval for which the data signal is turned OFF, and during a selection period after the predetermined selection period, an interval for which the data signal is turned ON may be set after an interval for which the data signal is turned OFF. Accordingly, if the above-described so-called "right-adjust left-adjust pulse width modulation driving" is employed, crosstalk can be effectively reduced.

It is preferable that a line inversion drive method in which voltage polarities of the scanning signal and the data signal are simultaneously inverted a plurality of times in one frame may be used. In this case, crosstalk can be effectively reduced.

According to another aspect of the invention, there is provided an electronic apparatus including one of the aforementioned electro-optical device and the electro-optical device driven by the aforementioned drive method. With this configuration, it is possible to provide an electronic apparatus exhibiting high display quality.

BRIEF DESCRIPTION OF THE DRAWINGS

The invention will be described with reference to the accompanying drawings, wherein like numbers reference like elements.

FIG. 3A is a waveform diagram illustrating a data signal according to an embodiment of the invention, and |FIG. 3B| is a waveform diagram illustrating a data signal according to known art.

DESCRIPTION OF EXEMPLARY EMBODIMENTS

Figure 1:
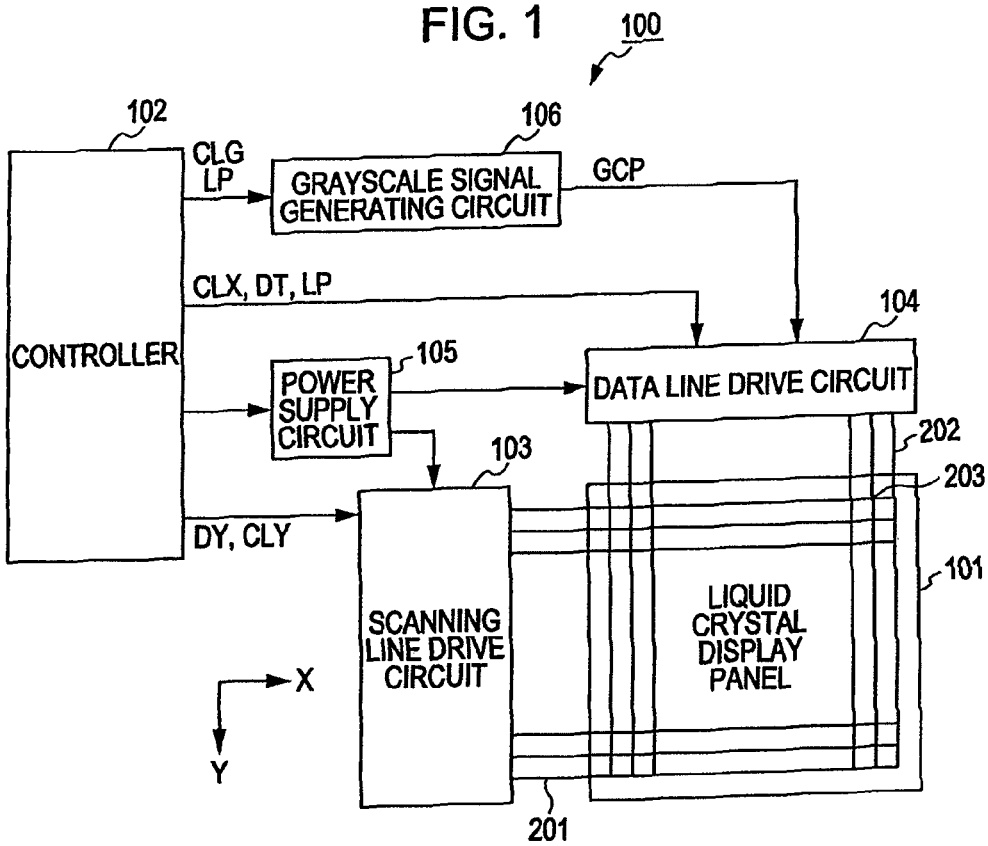
FIG. 1 is a block diagram illustrating the overall configuration of a liquid crystal device according to an embodiment of the invention.

An electro-optical device according to an embodiment of the invention is described below in the context of a liquid crystal device. In the following description, various structures are shown by way of examples with reference to the accompanying drawings, and for easy understanding of characteristic portions of the structures, the dimensions of the structures shown in the drawings may be different from the actual dimensions.

Electro-Optical Device

The configuration of a liquid crystal device 100 shown in FIG. 1 according to an embodiment of the invention is first described below. The liquid crystal device 100 includes, as shown in FIG. 1, a liquid crystal display panel 101, a controller 102, a scanning line drive circuit 103, a data line drive circuit (signal line drive circuit) 104, a power supply circuit 105, and a grayscale signal generating circuit 106.

The liquid crystal display panel 101, which is a passive-matrix-drive-type liquid crystal panel (electro-optical panel), includes a plurality of scanning lines 201 extending in the row direction (X direction), a plurality of data lines 202 extending in the column direction (Y direction), and a plurality of pixels 203 disposed at the intersections between the corresponding scanning lines 201 and the corresponding data lines 202. More specifically, in the liquid crystal display panel 101, liquid crystal (electro-optical material) is held between a pair of substrates, and in the passive-matrix-drive-type liquid crystal display panel 101, the pixels 203 are disposed at the intersections between band scanning electrodes, which are disposed on the inner surface of one substrate and electrically connected to the scanning lines 201, and band data electrodes, which are disposed on the inner surface of the other substrate and electrically connected to the data lines 202.

The controller 102 is connected to the scanning line drive circuit 103, the data line drive circuit 104, the power supply circuit 105, and the grayscale signal generating circuit 106, and controls those elements in response to a program stored in a memory or commands from an external source.

That is, the controller 102 supplies control signals to those elements. More specifically, the controller 102 supplies a start pulse signal DY defining one vertical scanning period (1F) and a clock signal CLY defining a horizontal scanning period, i.e., one selection period (1H) for selecting one scanning line 201, to the scanning line drive circuit 103. The controller 102 supplies a clock signal CLX, which is a dot clock signal for data writing, display data DT, and a latch pulse LP for retaining written data during one selection period to the data line drive circuit 104. The controller 102 supplies a latch pulse signal LP and a grayscale reference clock CLG to the grayscale signal generating circuit 106.

The scanning line drive circuit 103 is connected to the controller 102 and the scanning lines 201 of the liquid crystal display panel 101. The scanning line drive circuit 103 sequentially selects the scanning lines 201 under the control of the controller 102 by outputting a scanning signal to select one scanning line 201 during every selection period (1H). According to this scanning operation, pixel rows into which data is written are sequentially selected in a predetermined scanning direction (generally, from the top to the bottom) during one frame period (1F).

The data line drive circuit 104 is connected to the controller 102, the grayscale signal generating circuit 106, and the data lines 202 of the liquid crystal display panel 101. The data line drive circuit 104 outputs a data signal to the pixel row selected by the scanning line drive circuit 103 on the basis of a GCP| signal supplied from the controller 102 and the grayscale signal generating circuit 106. More specifically, the data line drive circuit 104 outputs a grayscale pulse based on the display data and the GCP signal to the pixel row into which data is to be written in the current selection period 1H, and simultaneously, dot-sequentially latches data for the pixel row to which the data is to be written in the subsequent selection period 1H.

The power supply circuit 105 is connected to the controller 102, the scanning line drive circuit 103, and the data line drive circuit 104. Under the control of the controller 102, the power supply circuit 105 generates a voltage required for scanning the scanning lines 201 and supplies the generated voltage to the scanning line drive circuit 103, and also generates a voltage required for driving the data lines 202 and supplies the generated voltage to the data line drive circuit 104.

Figure 2:
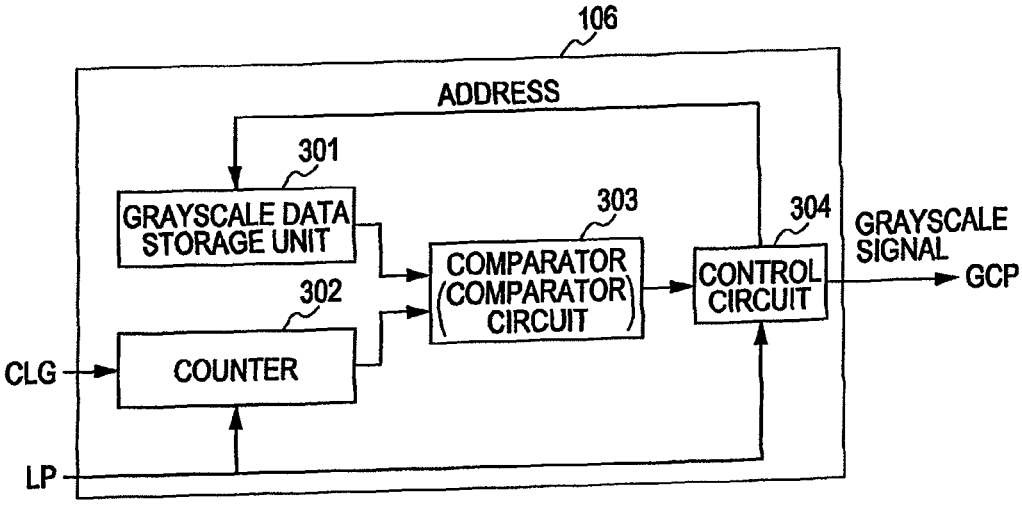
FIG. 2 is a block diagram illustrating the configuration of a grayscale signal generating circuit.

The grayscale signal generating circuit 106 includes, as shown in FIG. 2, a grayscale data storage unit 301, a counter 302, a comparator 303, and a control circuit 304. Data defining the pulse width of an ON voltage in accordance with each grayscale level is written into the grayscale data storage unit 301 from the controller 102 or an external source. The grayscale data storage unit 301 outputs predetermined grayscale level data to the comparator 303 according to the address supplied from the control circuit 304. The counter 302 counts the rises or falls of the clock signal CLG and outputs the count number to the comparator 303. The counter 302 is initialized by using the latch pulse signal LP as the reset signal. The comparator 303 compares the count number output from the counter 302 with the grayscale level data output from the grayscale data storage unit 301, and if the two values are the same, the comparator 303 outputs a pulse to the control circuit 304. The control circuit 304 outputs the pulse to the data line drive circuit 104 and also increments the address of the grayscale data storage unit 301 by one. The control circuit 304 is initialized by using the latch pulse signal LP as the reset signal.

In this manner, the control circuit |104| outputs the pulse as the GCP signal based on the grayscale level to the data line drive circuit 104 during one selection period (1H). The rising or falling timing of the pulse of the GCP signal defines the pulse width |of the ON voltage in accordance with each grayscale level.

Drive Method for Electro-optical Device

A drive method for the liquid crystal device 100 in accordance with this embodiment of the invention is as follows.

In this embodiment, in a |predetermined selection period (1H)|, an interval for which a data signal is turned ON is set before an interval for which the data signal is turned OFF. In the |subsequent selection period (1H)|, an interval for which the data signal is turned ON is set after an interval for which the data signal is turned OFF. That is, grayscale display is performed in the normally |black mode| by using so-called "right-adjust left-adjust pulse width modulation driving".|

The invention is not restricted to this type of driving, and |right-adjust pulse width modulation |driving or left-adjust pulse width modulation |driving may be employed. The invention is also applicable to grayscale display in the normally white mode.

Figure 3A:
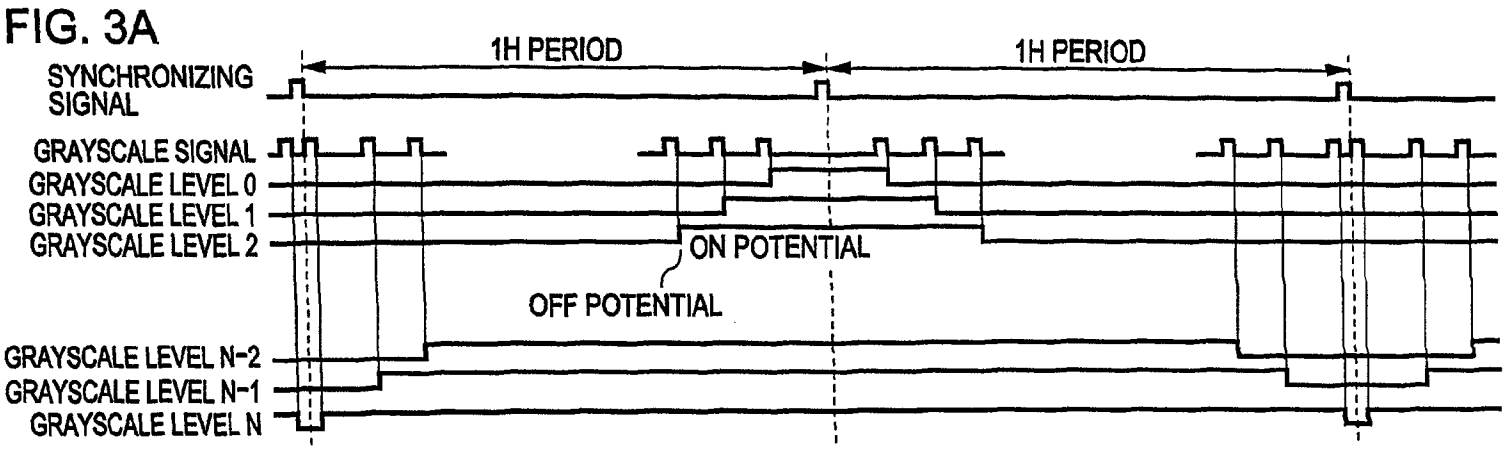
FIGS. 3A and 3B are waveform diagrams of data signals subjected to right-adjust left-adjust pulse width modulation.
Figure 3B:
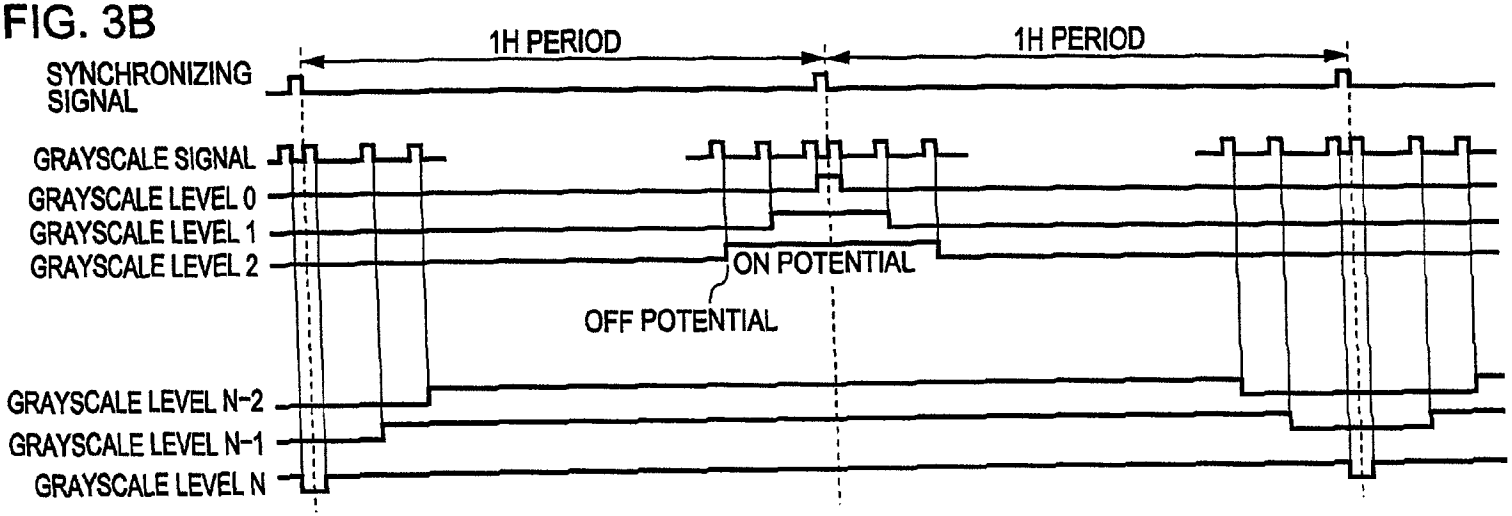

FIGS. 3A and 3B are waveform diagrams illustrating data signals subjected to right-adjust left-adjust pulse width modulation driving by the data line drive circuit 104. FIG. 3A is a waveform diagram illustrating a data signal according to this embodiment of the invention, and FIG. 3B is a waveform diagram illustrating a data signal according to known art.

According to the drive method of the liquid crystal device 100 of this embodiment, in one selection period (1H) during which a data signal is output to the selected pixel 203, as shown in FIG. 3A, among grayscale levels 0 to N subjected to pulse width modulation with a predetermined number of grayscale levels, the |period| during which the grayscale level (grayscale level 0) having the longest OFF voltage interval is turned ON is set to be longer than the |period| during which the grayscale level (grayscale level N) having the longest ON voltage interval is turned OFF.

Figure 4:
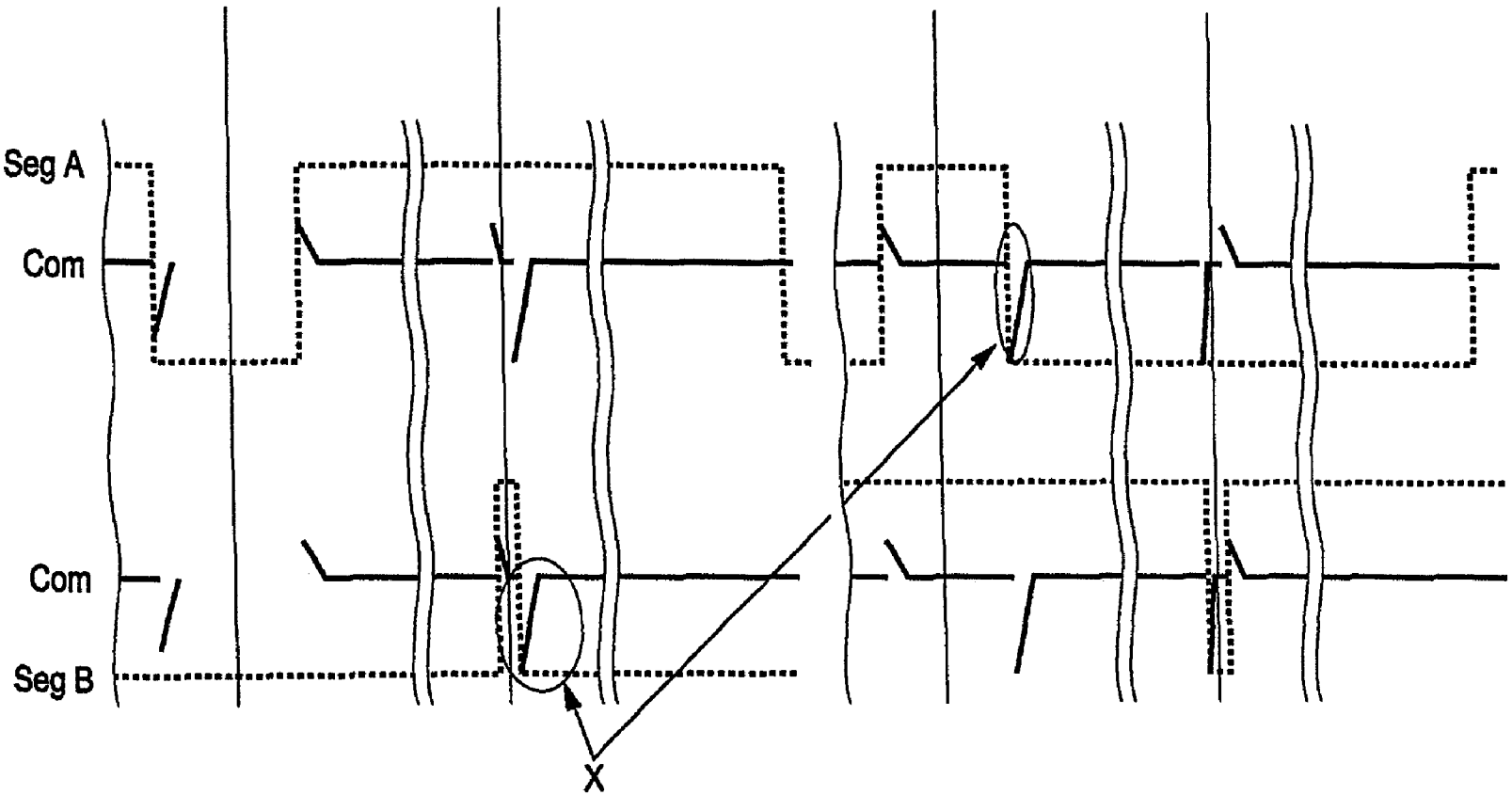
FIG. 4 is a waveform diagram illustrating a reduced level of crosstalk.
Figure 5:
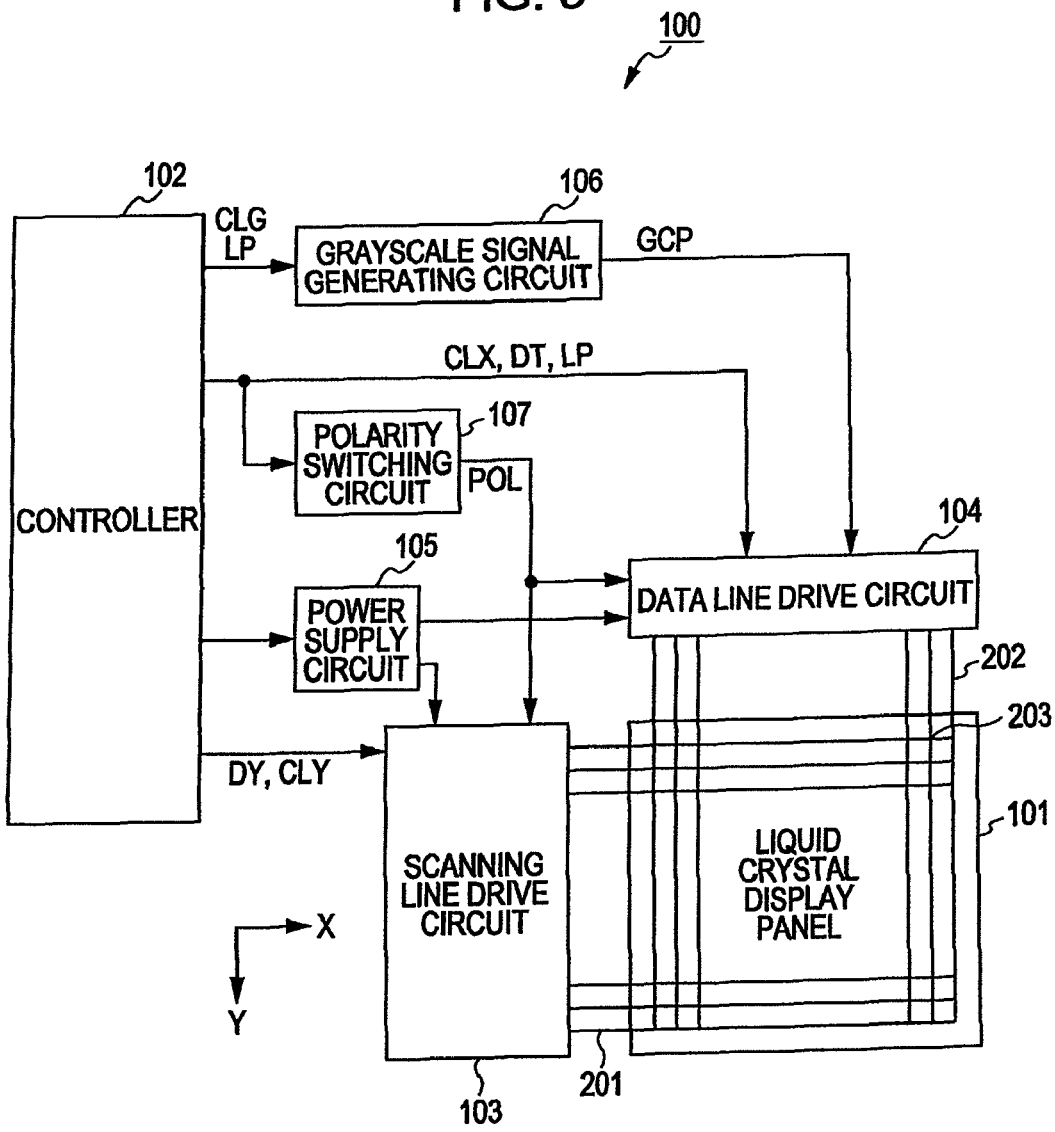
FIG. 5 is a block diagram illustrating the overall configuration of a liquid crystal device employing a line inversion drive method.

In this case, by setting the period during which the grayscale level (grayscale level 0) having the longest OFF voltage interval| to be longer than the |actual interval|, common noise occurring in the grayscale level (grayscale level 0) having the longest OFF voltage interval can be substantially equivalent to common noise occurring in the grayscale level (grayscale level N) having the longest ON voltage interval, as indicated by the elliptic portions X in FIG. 4. Accordingly, common noise |occurring in the grayscale level 0 and |common noise| occurring in the grayscale level N become |symmetrical to each other with respect to the polarity|, and cancel each other out. Then, the grayscale level 0 and the grayscale level N have the |same effective voltage|, thereby reducing the level of crosstalk.

In this embodiment of the invention, when the period during which the grayscale level (grayscale level 0) having the longest OFF voltage interval is turned ON is indicated by $T_0$, and when the period during which the grayscale level (grayscale level N) having the longest ON voltage interval is turned OFF is indicated by $T_N$, $T_0/T_N$ is preferably set to be 3 to 20.

Figure 7:
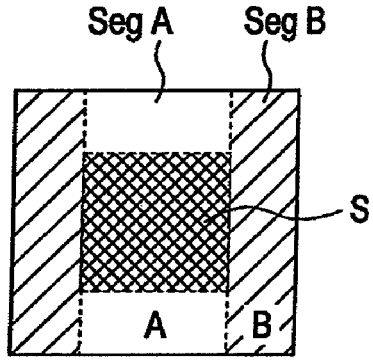
FIG. 7 is a schematic diagram illustrating crosstalk.
Figure 8A:
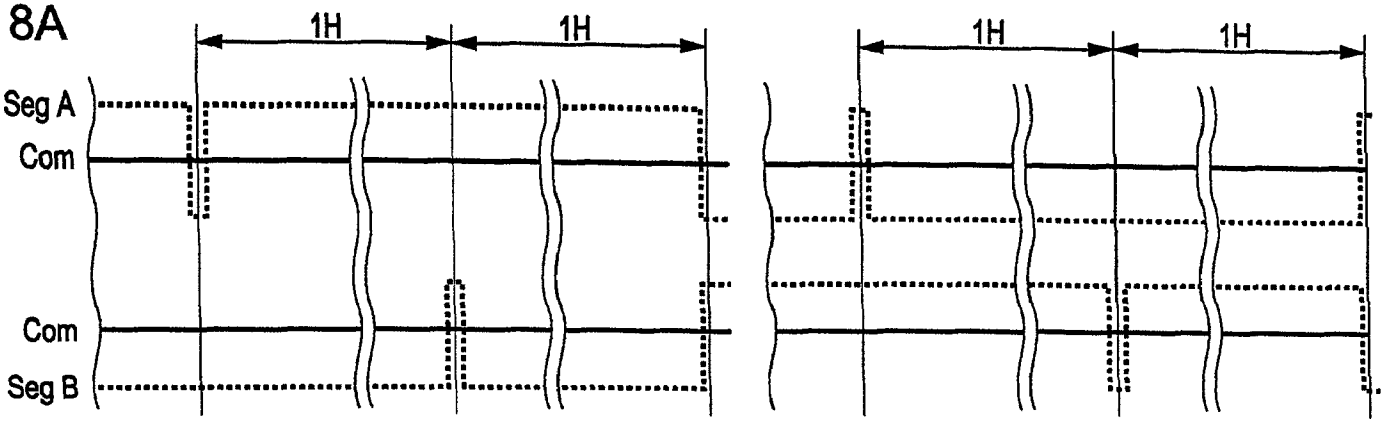
FIGS. 8A and 8B are waveform diagrams illustrating the occurrence of crosstalk in known art.
Figure 8B:
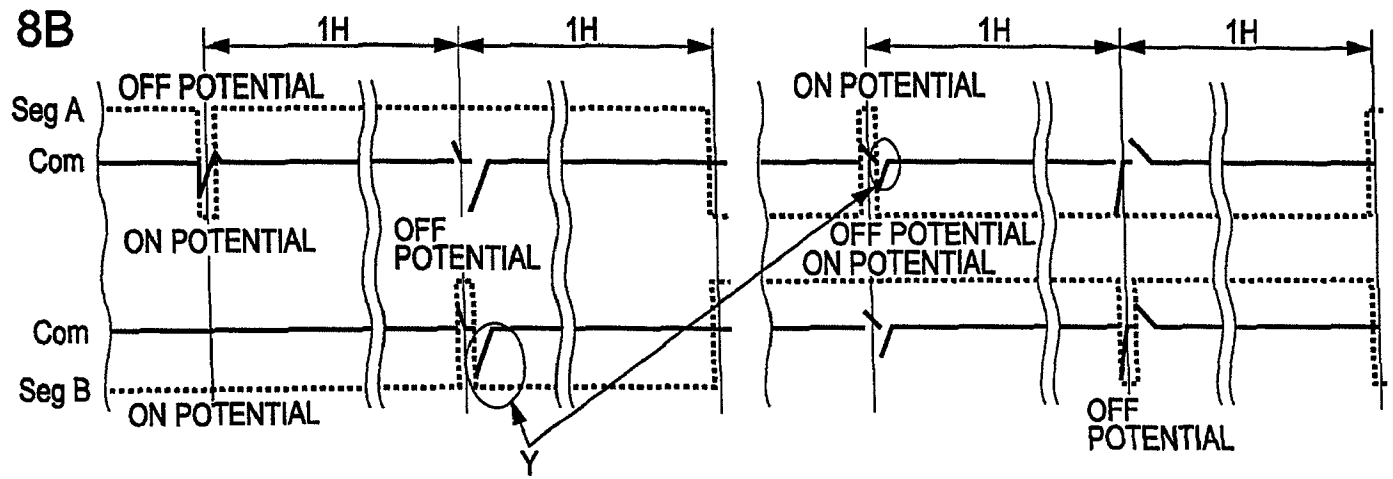

The levels of crosstalk were measured by varying $T_0/T_N$ when the black color image S was displayed in the white frame image shown in FIG. 7. The measurement results are indicated in Table 1.

In the measurements, during one selection period (1H), among grayscale levels 0 to 63 subjected to pulse width modulation with 64 grayscale levels, the period during which the grayscale level 63 is turned OFF was set to be H/128, and the period during which the grayscale level 0 is turned ON was changed to H/128, 3H/128, 6H/128, 10H/128, 13H/128, 20H/128, and 23H/128, and then, the levels of crosstalk were measured. When the luminance of portion A and the luminance of portion B shown in FIG. 7 are indicated by TA and TB, respectively, the level of crosstalk is represented by (TA-TB)/TB.

TABLE 1

| | Period during which grayscale level 63 is OFF | Period during which grayscale level 0 is ON | Crosstalk value = (TA − TB)/TB | Crosstalk level | Contrast | Contrast ratio in relation to Known Example 1 |
|---|---|---|---|---|---|---|
| Known Example 1 | H/128 | H/128 | 3.64% | Poor | 37.4 | 1.00 |
| Example 1 | H/128 | 3H/128 | 2.54% | Improved | 37 | 0.99 |
| Example 2 | H/128 | 6H/128 | 1.72% | Good | 36.2 | 0.97 |
| Example 3 | H/128 | 10H/128 | 0.86% | Good | 35.5 | 0.95 |

TABLE 1-continued

| | Period during which grayscale level 63 is OFF | Period during which grayscale level 0 is ON | Crosstalk value = (TA − TB)/TB | Crosstalk level | Contrast | Contrast ratio in relation to Known Example 1 |
|---|---|---|---|---|---|---|
| Example 4 | H/128 | 13H/128 | 0.74% | Good | 34.7 | 0.93 |
| Example 5 | H/128 | 20H/128 | 0.52% | Good | 31.2 | 0.83 |
| Comparative Example 1 | H/128 | 23H/128 | 0.52% | Good | 27.5 | 0.74 |

Table 1 shows that, as the period during which the grayscale level 0 is turned ON becomes longer, the level of crosstalk is decreased, but on the other hand, the contrast is deteriorated. It is undesirable if the contrast is reduced by 25% or higher compared to a known driving method (known example 1). Accordingly, if the period during which the grayscale level 0 is turned ON ranges from 3/128H to 20/128H, the level of crosstalk can be decreased without impairing the contrast.

The liquid crystal device 100 is not restricted to the configuration shown in FIG. 1. For example, a line inversion drive method in which the voltage polarities of a scanning signal and a data signal are simultaneously inverted a plurality of times during one frame may be employed in the liquid crystal device 100.

More specifically, if the line inversion drive method is employed, the liquid crystal device 100 includes a polarity switching circuit 107 in addition to the elements shown in FIG. 1. The polarity switching circuit 107 is connected to the controller 102, the scanning line drive circuit 103, and the data line drive circuit 104. Under the control of the controller 102, the polarity switching circuit 107 supplies a polarity inverting signal POL for simultaneously inverting the voltage polarities of a scanning signal and a data signal a plurality of times during one frame to the scanning line drive circuit 103 and the data line drive circuit 104.

According to the configuration using the line inversion drive method, as well as the configuration shown in FIG. 1, by setting, as shown in FIG. 3A, the period during which the grayscale level (grayscale level 0) having the longest OFF voltage interval is turned ON to be longer than the period during which the grayscale level (grayscale level N) having the longest ON voltage interval is turned OFF, the level of crosstalk can be reduced.

To implement the higher contrast level and driving with lower voltage, the liquid crystal device 100 may employ a multi-line selection (MLS) drive method in which a plurality of scanning lines are simultaneously selected. Regardless of whether the MLS driving method or a regular driving method is used, the level of crosstalk can be reduced.

Electronic Apparatus

Figure 6:
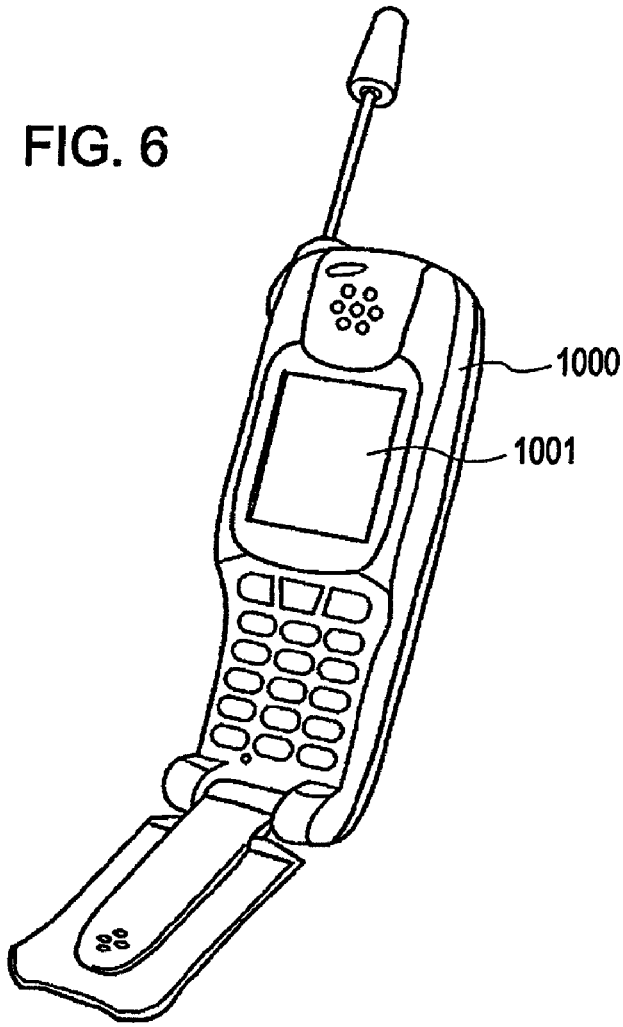
FIG. 6 is a perspective view illustrating an example of an electronic apparatus according to an embodiment of the invention.

A cellular telephone 1000, which is a specific example of an electronic apparatus, according to an embodiment of the invention is described below with reference to the perspective view of FIG. 6.

The above-described liquid crystal device 100 is used as a display unit 1001 of the cellular telephone 1000. Accordingly, in the cellular telephone 1000, the level of crosstalk can be reduced, and thus, high-quality display images can be obtained.

The liquid crystal display device (electro-optical device) according to an embodiment of the invention can be used, not only as the display unit of the cellular telephone 1000, but also as display units of other electronic apparatuses, such as digital books, personal computers, digital still cameras, liquid crystal televisions, view-finder-type or monitor-direct-view-type video recorders, car navigation systems, pagers, digital diaries, calculators, word-processors, workstations, videophones, point-of-sale (POS) terminals, and touch panels.

In the invention, electro-optical materials, electro-optical panels, and electro-optical devices are not only materials and devices exhibiting an electro-optical effect in which the light transmittance ratio is changed by a change in the refractive index of a material due to an electric field, but also materials and devices converting electric energy into light energy.

While the invention has been described with reference to an exemplary embodiment with reference to the accompanying drawings, it is to be understood that the invention is not limited to the disclosed exemplary embodiment. That is, various configurations and combinations of the elements in the above-described embodiment are examples only, and various modifications may be made in accordance with factors, such as designs, without departing from the spirit of the invention.

What is claimed is:

1. An electro-optical display device, comprising:

an electro-optical panel including a plurality of scanning lines, a plurality of data lines intersecting with the corresponding scanning lines, and a plurality of pixels disposed at intersections of the corresponding scanning lines and data lines;

a scanning line drive circuit for scanning the scanning lines by supplying a scanning signal to at least one of the scanning lines during a selection period; and a data line drive circuit for outputting a data signal to a predetermined pixel through the corresponding data line in synchronization with the scanning of the scanning line drive circuit, wherein, during the selection period during which the data signal is output to the predetermined pixel, said data signal comprises an OFF voltage interval and an ON voltage interval, said ON voltage interval causing the predetermined pixel to display one of a plurality of grayscale levels in accordance with a duration of said ON voltage interval, and wherein the duration ($T_0$) of the ON voltage interval corresponding to a grayscale level having a longest OFF voltage interval is set to be longer than the duration ($T_N$) of the OFF voltage interval corresponding to a grayscale level having a longest ON voltage interval.

2. The electro-optical display device according to claim 1, wherein $T_0/T_N$ ranges from 3 to 20.

3. The electro-optical display device according to claim 1, wherein during a predetermined one of two successive selection periods, the ON voltage interval of the data signal is before the OFF voltage interval of the data signal, and during the other of said two successive selection periods, the ON voltage interval of the data signal is after the OFF voltage interval of the data signal.

4. The electro-optical display device according to claim 1, further comprising a polarity switch for performing a line inversion drive method in which voltage polarities of the scanning signal and the data signal are simultaneously inverted a plurality of times in one frame by said polarity switch.

5. A method of driving an electro-optical display device, the electro-optical display device including an electro-optical panel including a plurality of scanning lines, a plurality of data lines intersecting with the corresponding scanning lines, and a plurality of pixels disposed at intersections of the corresponding scanning lines and data lines, the method comprising:

scanning the scanning lines by supplying a scanning signal to at least one of the scanning lines during a selection period; and outputting a data signal to a predetermined pixel through the corresponding data line in synchronization with said scanning, wherein, during the selection period during which the data signal is output to the predetermined pixel, said data signal comprises an OFF voltage interval and an ON voltage interval, said ON voltage interval causing the predetermined pixel to display one of a plurality of grayscale levels in accordance with a duration of said ON voltage interval, and wherein the duration ($T_0$) of the ON voltage interval corresponding to a grayscale level having a longest OFF voltage interval is set to be longer than the duration ($T_N$) of the OFF voltage interval corresponding to a grayscale level having a longest ON voltage interval.

6. The method according to claim 5, wherein $T_0/T_N$ ranges from 3 to 20.

7. The method according to claim 5, wherein during a predetermined one of two successive selection periods, the ON voltage interval of the data signal is before the OFF voltage interval of the data signal, and during the other of said two successive selection periods, the ON voltage interval of the data signal is after the OFF voltage interval of the data signal.

8. The method according to claim 5, further comprising using a line inversion drive method in which voltage polarities of the scanning signal and the data signal are simultaneously inverted a plurality of times in one frame.

9. An electronic apparatus, comprising the electro-optical display device set forth in claim 1.

10. An electronic apparatus, comprising an electro-optical display device driven by the method set forth in claim 5.

11. The method according to claim 5, further comprising:

providing an initial data signal intended for the predetermined pixel; and pulse-width modulating said initial data signal to obtain said data signal to be output to the predetermined pixel.

12. The method according to claim 11, wherein said pulse-width modulating comprises selectively extending the duration of an ON voltage interval of the initial data signal to obtain the data signal to be output to the predetermined pixel.

13. The method according to claim 12, wherein said extending is performed at least for the initial data signal corresponding to the grayscale level having the longest OFF voltage interval.

14. The method according to claim 12, wherein said extending is performed at least for the initial data signal corresponding to one of (i) the grayscale level having the longest OFF voltage interval, (ii) a grayscale level having a second longest OFF voltage interval, and (iii) a grayscale level having a third longest OFF voltage interval.

15. A control unit for controlling an electro-optical display device, said display device comprising an electro-optical panel including a plurality of scanning lines, a plurality of data lines intersecting with the corresponding scanning lines, and a plurality of pixels disposed at intersections of the corresponding scanning lines and data lines, said control unit comprising:

a scanning line drive circuit for scanning the scanning lines by supplying a scanning signal to at least one of the scanning lines during a selection period; and a data line drive circuit for outputting a data signal to a predetermined pixel through the corresponding data line in synchronization with the scanning of the scanning line drive circuit, wherein, during the selection period during which the data signal is output to the predetermined pixel, said data signal comprises an OFF voltage interval and an ON voltage interval, said ON voltage interval causing the predetermined pixel to display one of a plurality of grayscale levels in accordance with a duration of said ON voltage interval, and wherein the duration ($T_0$) of the ON voltage interval corresponding to a grayscale level having a longest OFF voltage interval is set to be longer than the duration ($T_N$) of the OFF voltage interval corresponding to a grayscale level having a longest ON voltage interval.

16. The control unit according to claim 15, wherein $T_0/T_N$ ranges from 3 to 20.

17. The control unit according to claim 15, wherein during a predetermined one of two successive selection periods, the ON voltage interval of the data signal is before the OFF voltage interval of the data signal, and during the other of said two successive selection periods, the ON voltage interval of the data signal is after the OFF voltage interval of the data signal.

18. The control unit according to claim 15, further comprising a polarity switch for performing a line inversion drive method in which voltage polarities of the scanning signal and the data signal are simultaneously inverted a plurality of times in one frame by said polarity switch.

19. The control unit according to claim 15, further comprising:

a controller for outputting an initial data signal intended for the predetermined pixel to said data line drive circuit; and a grayscale signal generating circuit for generating a GCP in accordance with the grayscale to be displayed by the predetermined pixel, and outputting said GCP to the data line drive circuit for pulse-width modulating said initial data signal with said GCP to obtain said data signal to be output to the predetermined pixel.

20. The control unit according to claim 19, wherein said grayscale signal generating circuit comprises:

a control circuit;

a counter for generating an incremental count;

a grayscale data storage unit for storing grayscale data defining the duration of an ON voltage interval for each grayscale level, and outputting appropriate grayscale data in response to an address from the control circuit; and a comparator for comparing said count with the grayscale data output from the grayscale data storage unit, and outputting a pulse to the control circuit when said count and grayscale data match;

wherein said control circuit is arranged for generating the GCP in response to said pulse output by the comparator.

* * * * *